US007775218B2

(12) United States Patent
Shraiber

(10) Patent No.: US 7,775,218 B2
(45) Date of Patent: Aug. 17, 2010

(54) TOBACCO CARTRIDGE PARTICULARLY FOR USE WITH NARGHILES

(76) Inventor: Mickey Shraiber, 130 Alexander Zaid Street, Kiryat-Haim (IL) 26301

( * ) Notice: Subject to any disclaimer, the term of this patent is extended or adjusted under 35 U.S.C. 154(b) by 1190 days.

(21) Appl. No.: 11/374,966

(22) Filed: Mar. 15, 2006

(65) Prior Publication Data

US 2006/0207621 A1 Sep. 21, 2006

Related U.S. Application Data

(60) Provisional application No. 60/661,909, filed on Mar. 16, 2005.

(51) Int. Cl.
*A24D 1/14* (2006.01)

(52) U.S. Cl. ..... 131/348

(58) Field of Classification Search ..... None
See application file for complete search history.

(56) References Cited

U.S. PATENT DOCUMENTS

| | | | | | |
|---|---|---|---|---|---|
| 1,967,438 | A | * | 7/1934 | Hartzes | 131/173 |
| 2,935,987 | A | * | 5/1960 | Ackerbauer | 131/348 |
| 3,292,634 | A | * | 12/1966 | Beucler | 131/348 |
| 3,468,314 | A | | 9/1969 | Palmer | |
| 3,545,449 | A | | 12/1970 | Pecor | |
| 4,648,410 | A | | 3/1987 | Seroussi et al. | |

* cited by examiner

*Primary Examiner*—Philip C Tucker
*Assistant Examiner*—Michael J Felton

(57) ABSTRACT

A tobacco cartridge for use with a narghile or other smoking appliance having a tobacco bowl for receiving tobacco includes a quantity of tobacco enclosed within an enclosure having a lower end configured for applying the cartridge to the tobacco bowl of the smoking appliance, and an upper end which is openable to provide access to the tobacco for igniting same. The upper end of the enclosure includes a metal foil which, after opened to permit access to the tobacco for igniting same, is foldable downwardly over and around the tobacco bowl for securing the cartridge to the tobacco bowl.

14 Claims, 3 Drawing Sheets

TOBACCO CARTRIDGE PARTICULARLY FOR USE WITH NARGHILES

RELATED APPLICATIONS

This application claims priority from U.S. Provisional Patent Application No. 60/661,909, filed on Mar. 16, 2005, the contents of which are incorporated herein by reference.

FIELD AND BACKGROUND OF THE PRESENT INVENTION

The present invention relates to smoking appliances, particularly narghiles, and to tobacco cartridges for use in such appliances.

A narghile, sometimes called a hookah or water pipe, is an oriental tobacco pipe in which smoke is drawn through a container of water by means of a flexible suction tube received within the smoker's mouth. Narghiles have been used for hundreds of years with little changes in their basic construction. They generally include a water container for containing a quantity of water, a tobacco bowl or head for receiving a quantity of tobacco to be burnt in order to produce smoke, and a suction tube communicating with the container above the level of the water therein for drawing smoke from the tobacco head through the water and the flexible suction tube into the mouth of the smoker.

The manner of using such narghiles has also changed very little over the years. Thus, when the narghile is to be used, a quantity of tobacco is placed by hand into the tobacco bowl, and then a glowing ember, e.g. of coal or wood, is placed over the tobacco so as to ignite the tobacco and thereby to produce the smoke. After each such use of the narghile, it has to be cleaned by removing and disposing the residue ashes of the tobacco and the ember, and cleaning the bowl.

The foregoing actions are both time-consuming and inconvenient, similar to the time-consuming and inconvenient actions involved in rolling cigarettes in the early days of cigarette smoking. Moreover, such narghiles utilize only the water for filtering out undesired contents of the smoke produced by the ignited tobacco. In addition, during the use of the narghile, liquids tend to settle out and to drop into the water container, thereby requiring frequent cleaning of the water container.

Similar inconvenient and time-consuming activities are required with respect to other smoking appliances, such as the conventional smoker's pipe.

OBJECTS AND BRIEF SUMMARY OF THE PRESENT INVENTION

An object of the present invention is to provide a smoking appliance, particularly a narghile, having advantages in the above respects. Another object of the invention is to provide a tobacco cartridge particularly useful in smoking appliances.

According to one aspect of the present invention, there is provided a tobacco cartridge for use with a narghile or other smoking appliance having a tobacco bowl for receiving tobacco, comprising: a quantity of tobacco enclosed within an enclosure; the enclosure having a lower end configured for applying the cartridge to the tobacco bowl of the smoking appliance, and an upper end which is openable to provide access to the tobacco for igniting same.

According to further features in the described preferred embodiment, the upper end of the enclosure includes a metal foil which is dimensioned such that, after opened to permit access to the tobacco for igniting same, it is foldable downwardly over and around the tobacco bowl for securing the cartridge to the tobacco bowl. Preferably, the metal foil is aluminum foil.

According to still further features in the described preferred embodiment, the lower end of the enclosure includes a metal base configured for reception in the tobacco bowl of the smoking appliance, and formed with a passageway for passing smoke from the tobacco, when ignited, into the smoking appliance.

According to still further features, the cartridge includes a filter underlying the quantity of tobacco therein, and a body of a combustible material e.g., coal or wood, capable, when ignited, to produce a glowing ember for igniting the tobacco.

Providing the tobacco in the form of a cartridge, according to the above features of the present invention, produces a number of important advantages. Thus, it provides the convenience of having all the elements necessary for using the smoking appliance included in a single cartridge unit so as to be immediately available when the smoking appliance is to be used. It eliminates, or substantially reduces, the need for finger contact with the tobacco, and the need to clean the smoking appliance after each use. Further, it facilitates the disposal of the ash residue of the tobacco and the ember material after use of the appliance. A still further advantage is that it enables a filter to be used, in addition to the water, for filtering the tobacco smoke.

It will thus be seen that the present invention provides narghile smokers, and smokers of other appliances, with many of the advantages and conveniences provided cigarette smokers when the now conventional pre-rolled cigarettes were first introduced to eliminate the need for rolling each cigarette.

According to still further features in the preferred embodiments of the invention described below, the quantity of tobacco in the cartridge is in the form of a disc. The cartridge further includes an apertured metal disc underlying the disc of tobacco. The underlying metal disc is preferably formed with channels for accumulating liquids separated from the tobacco when ignited. Since such liquids are separated from the tobacco before being drawn into the water of the water container, this feature tends to maintain the water container cleaner for longer periods of time.

According to another aspect of the present invention, there is a provided a smoking appliance having a tobacco bowl for receiving a quantity of tobacco to be ignited in order to produce smoke, with a tobacco cartridge constructed according to the above features, or any combination of such features.

While the invention is particularly useful with respect to narghiles, it will be appreciated that many of the advantages provided by some of the above features would also be present when such a cartridge is used with respect to a conventional smokers' pipes, e.g. the advantage of eliminating the need for cleaning the pipe bowl after each use, and/or the advantage of introducing a filter to separate undesired elements before being drawn into the smoker's mouth.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1:
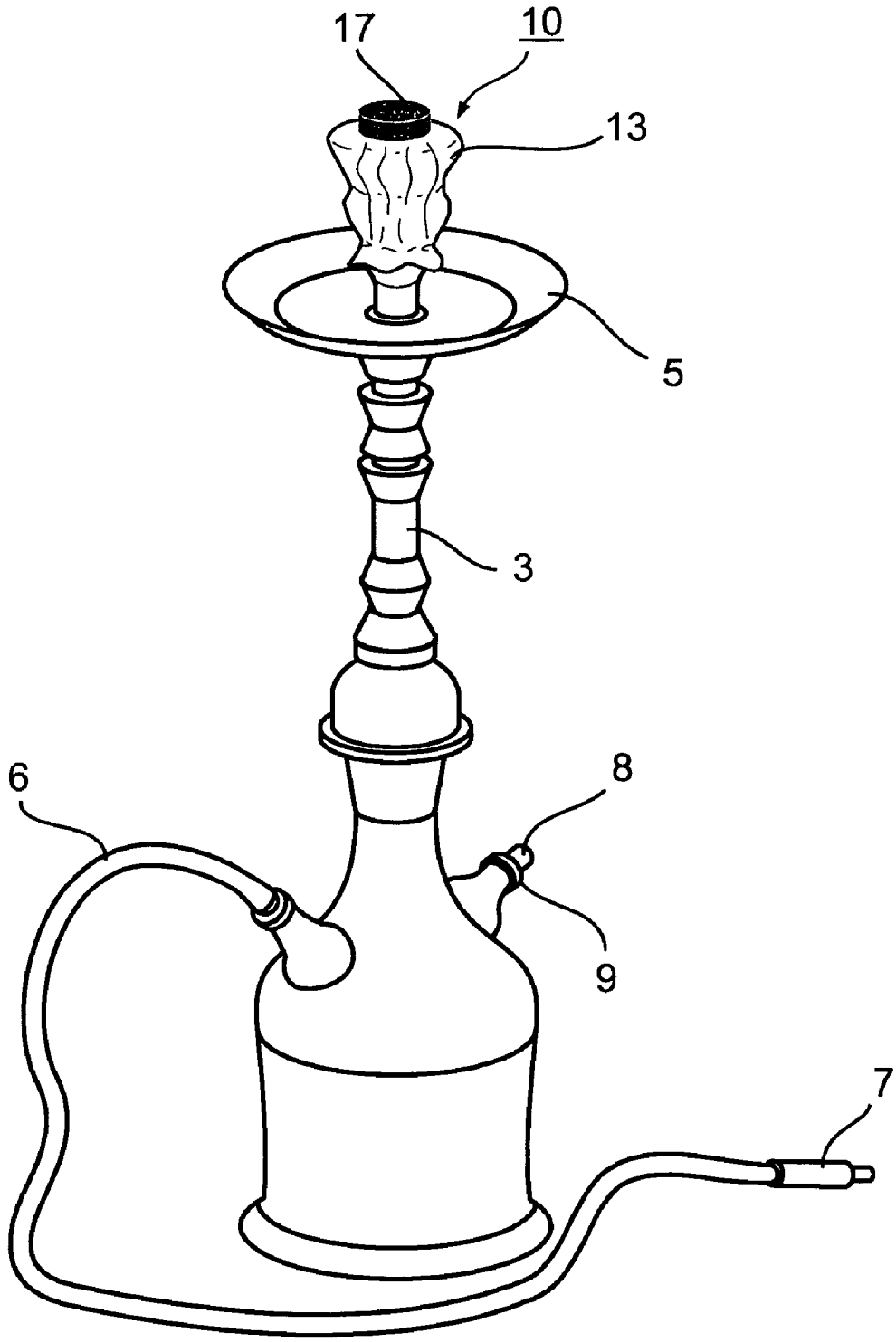
FIG. 1 illustrates a narghile including a tobacco cartridge constructed in accordance with the present invention ready for use.

FIG. 1 illustrates a narghile including a cartridge constructed in accordance with the present invention mounted in an open condition on the narghile ready for use. In FIG. 1, the tobacco cartridge constructed in accordance with the present invention is generally designated 10, and is more particularly described below with respect to FIGS. 2*a*-2*c*, while the manner of applying the cartridge to the narghile is described below with respect to FIGS. 3*a*-3*c*.

The narghile illustrated in FIG. 1 includes a water container 2 which serves as the base of the narghile, and an upwardly-extending stand 3 terminating at its upper end by a tobacco bowl or head 4 (FIG. 3*a*) for receiving the tobacco, in this case, tobacco cartridge 10. Underlying the pipe bowl 4 is a circular tray 5 serving as an ash receptor for receiving the ash residue of the burnt tobacco as well as the combustible body (e.g. a piece of coal or wood) which is ignited to produced the glowing ember for igniting the tobacco.

The narghile illustrated in FIG. 1 further includes a long flexible suction tube 6 communicating with the interior of container 2, above the level of the water therein. Suction tube 6 is fitted at its outer end with a mouthpiece 7 to be received within the mouth of the smoker. The construction is such that the suction produced by the smoker draws smoke from the ignited tobacco within the tobacco bowl 4 through the water within container 2, and via suction tube 6 and mouthpiece 7 into the smoker's mouth.

Figure 3A:
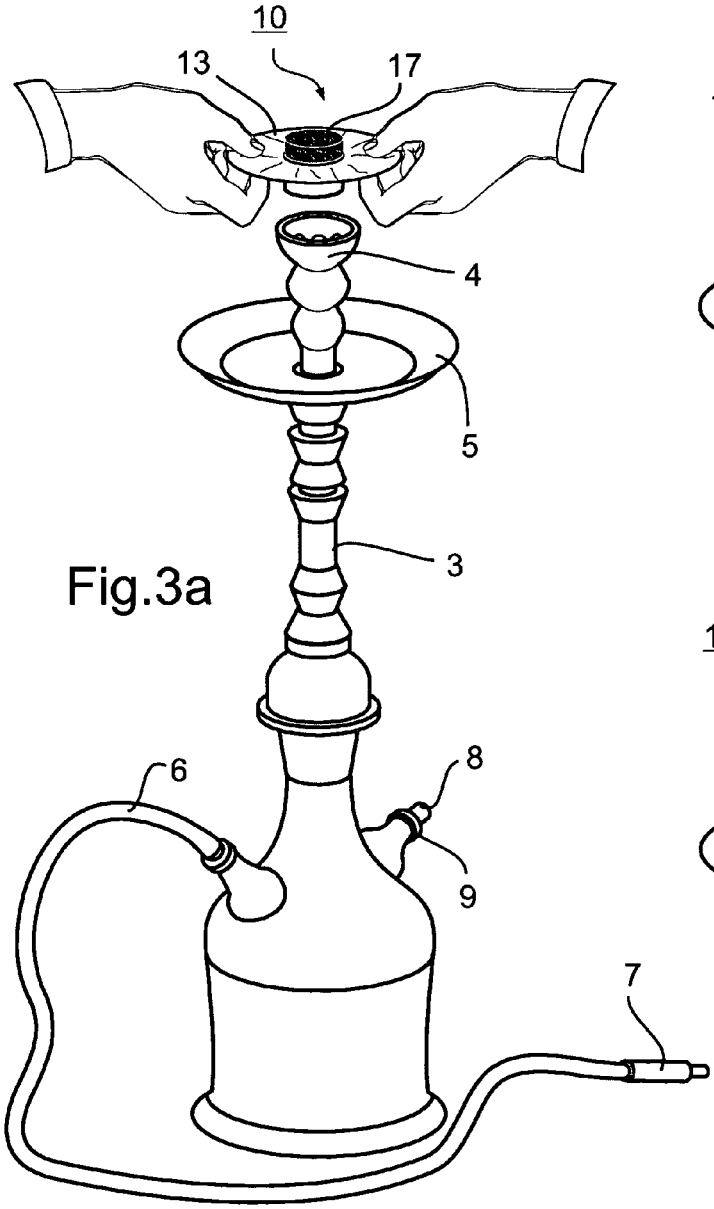
FIGS. 3*a*-3*c* illustrate different stages in the application of the cartridge of FIGS. 2*a*-2*c*, to the narghile of FIG. 1.

The narghile illustrated in FIGS. 1 and 3*a* further includes an air inlet 8 having a manually-adjustable valve 9 to enable adjustment of the concentration of the tobacco smoke to be drawn into the smoker's mouth. Thus, adjusting valve 9 to restrict the air inflow via inlet 8 increases the concentration of the tobacco smoke drawn into the smoker's mouth.

Figure 2A:
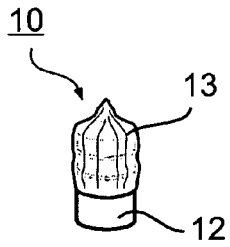
FIG. 2*a* illustrates the cartridge in its initial form.
Figure 2B:
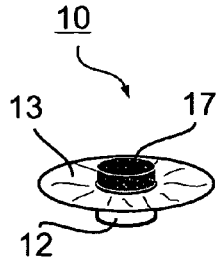
FIG. 2*b* illustrates the cartridge when first opened for use.
Figure 2C:
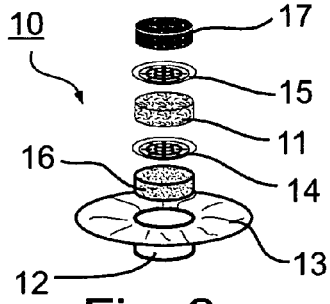
FIG. 2*c* illustrates the various elements included within the cartridge.

According to an important aspect of the present invention, the tobacco to be received within the tobacco bowl or head (4, FIG. 3*a*) is in the form of a cartridge, generally designated 10. FIG. 1 illustrates the cartridge 10 after it has been applied to the tobacco head 4 in the manner described below with respect to FIGS. 3-3*c*. FIG. 2*a* illustrates the initial condition of the cartridge; FIG. 2*b* illustrates its open condition: and FIG. 2*c* illustrates the various elements included within the cartridge in its initial condition. The various elements of the cartridge as illustrated in FIG. 2*c*, are also more particularly illustrated in FIGS. 4-6, relating to a modification in the construction of certain elements included within the cartridge, as will be more particularly described below.

Figure 4:
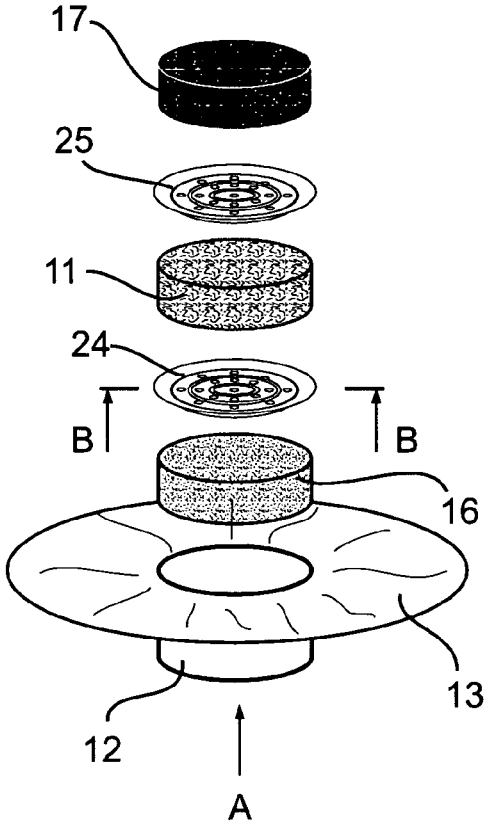
FIG. 4 is an exploded view illustrating a modification in the construction of some of the elements of the cartridge of FIG. 2*c;*

Cartridge 10, in its initial condition as illustrated in FIG. 2*a*, includes a quantity of tobacco, as shown at 11 in FIGS. 2*c* and 4, within an enclosure. The enclosure is constituted of a base 12 at its lower end, and a metal foil 13 at its upper end. The enclosure initially encloses the quantity of tobacco 11, as well as several other elements used in the narghile as will be described more particularly below with respects to FIGS. 2*c* and 4.

Metal base 12 is configured for reception in the tobacco bowl 4. It is formed with a plurality of passageways, as shown at 12*a* in FIG. 5, for passing therethrough the smoke from the tobacco when ignited.

Metal foil 13 is, in the initial condition of the cartridge as shown in FIG. 2*a*, closed so as to enclose all the elements of the cartridge, but is openable, as shown in FIG. 2*b*, to permit access to these elements, particularly the tobacco 11 within the cartridge, for igniting the tobacco. As will be described more particularly below, after metal foil 13 has been opened, as shown in FIG. 2*b*, it is foldable downwardly over the tobacco bowl 4, as shown in FIG. 3*c*, for securing the cartridge and its contents to the tobacco bowl. Metal foil 13, and also the metal base 12 of the above-described enclosure, are preferably of aluminum.

As shown in FIGS. 2*c* and 4, metal base 12 and metal foil 13 enclose, in the initial condition of the cartridge, not only the tobacco 11, but a number of additional elements. The quantity of tobacco within cartridge 10 is in the form of a disc 11. Tobacco disc 11 is sandwiched between an underlying apertured metal disc 14 and an overlying apertured metal disc 15.

Cartridge 10 further includes a filter disc 16 underlying the lower apertured metal disc 14, for purposes of filtering the smoke drawn from the tobacco disc 11 before even reaching the water within container 2. Filter 16 may be of any of the filter materials now commonly used in filtered cigarettes for filtering the cigarette smoke.

Cartridge 10 further includes, over the upper apertured metal disc 15, a disc 17 of a combustible material, such as coal or wood, capable when ignited of producing a glowing ember to ignite the tobacco disc 11, and thereby to produce the smoke inhaled by the smoker. Since the ember-producing disc 17 is at the upper end of the stack of discs included within the cartridge, it will be exposed for ignition as soon as metal foil 13 of the enclosure is opened and wrapped around the tobacco bowl 4 when the cartridge is applied to the narghile.

Figure 3B:
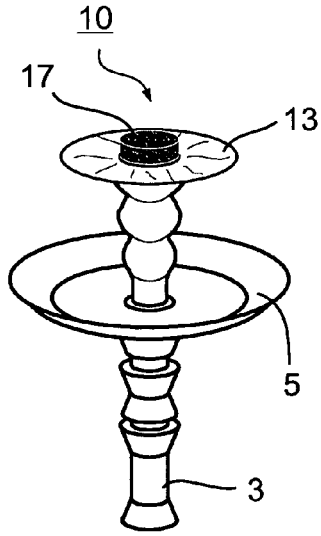
Figure 3C:
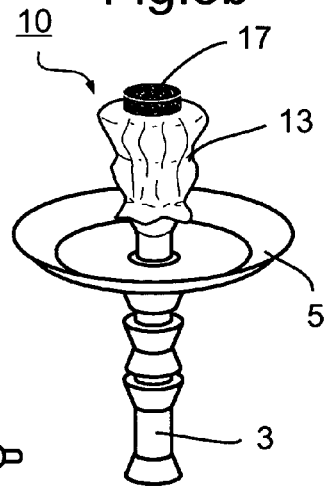

FIGS. 3*a*-3*b* illustrate the manner of applying the cartridge 10 to the tobacco head 4 of the narghile. Thus, as shown in FIG. 3*a*, the cartridge in its initial closed form as illustrated in FIG. 2*a*, is opened by the user's fingers which press the metal foil 13 outwardly and then press base 12 into the tobacco bowl 4 of the narghile, as shown in FIGS. 3*a* and 3*b*. The metal foil 13 is then folded downwardly over the tobacco bowl 4, as shown in FIG. 3*c*. This exposes the ember-producing disc 17 and all the other elements included within the cartridge 10.

The ember-producing element 17 may then be ignited, which in turn ignites the tobacco disc 11 causing it to produce smoke. The so-produced smoke is drawn through the apertured metal disc 14, the underlying filter disc 16, and through the passageways 12*a* (FIG. 5) in the metal base 12 into the interior of the water container 2. The smoke thus passes through the water in container 2 before reaching the suction tube 6 and before drawn into the smoker's mouth via the mouthpiece 7. As indicated earlier, the concentration of the inhaled smoke may be varied by adjusting valve 9 controlling the air inlet 8.

After the tobacco disc 11 has been fully consumed, metal foil 13 of the enclosure may then be folded upwardly to its initial closed condition, as illustrated in FIG. 2*a*, thereby to enclose the ash residues of the burnt tobacco disc 11 and ember-producing disc 17, as well as the apertured metal discs 14, 15 sandwiching the tobacco disc 11, and also the filter disc 16. This permits convenient disposal of all the foregoing elements without the necessity of cleaning the tobacco bowl 4.

Figure 6:
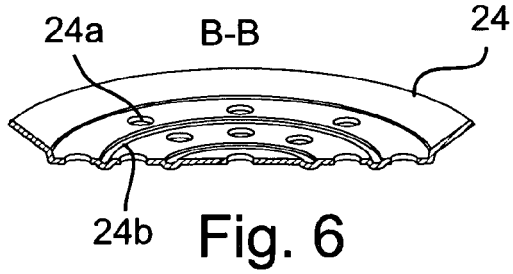
FIG. 6 is an enlarged fragmentary view of one of the metal discs in the cartridge of FIG. 4 along line B-B of FIG. 4.
Figure 5:
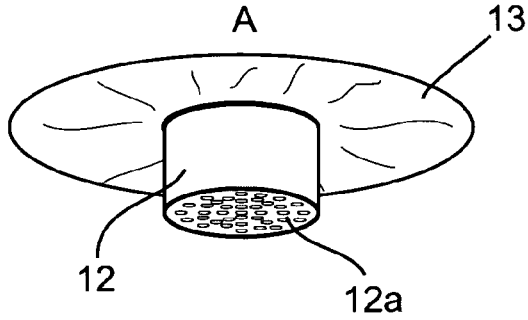
FIG. 5 is a view of the cartridge, in its open condition, along line A of FIG. 4.

FIGS. 4-6 illustrate a slight modification in the construction of the apertured metal discs, corresponding to discs 14 and 15 in FIG. 2*c*. These metal discs, as identified by the reference numerals 24 and 25 respectively in FIG. 4, are formed not only with the apertures as shown at 24*a* in FIG. 6, but also with annular channels as shown in 24*b* in FIG. 6. The remaining elements of the cartridge illustrated in FIG. 4 are the same as described above with respect to FIG. 2*c*, and therefore carry the same reference numerals to facilitate understanding.

Thus, in the modification illustrated in FIGS. 4-6, the apertures 24*a* formed in the lower metal disc 24 also serve as passageways for the smoke produced by the tobacco disc 11, when ignited. The annular channels 24*b* in the apertured metal disc 24 serve to accumulate any liquids or drippings from the ignited tobacco 11. The liquid drippings are thus retained within the cartridge for disposal with the cartridge, rather dripping into the interior of container 2. Such an arrangement reduces the frequency at which the water within container 2 must be changed.

The upper metal disc 25 is preferably of the same construction as the lower metal disc 24 to minimize initial tooling costs, as well as inventory costs. The upper aperture disc 25 of FIG. 4 (as well as 15 of FIG. 2*c*) could be omitted entirely, whereupon the ember-producing disc 17 will be in direct contact with tobacco disc 11 in the initial configuration of the cartridge (FIG. 2*a*) as well as in its open condition when used (FIGS. 1, 3).

While the invention has been described particularly with respect to a cartridge for use with a narghile, it will be appreciated such a cartridge, or elements thereof, can also be advantageously used in other smoking appliances, such as in a conventional smoker's pipe. Thus, when so used, such a cartridge would also provide the convenience of having all the elements in a form for one-time use and for quick disposal, without the necessity of having to clean the pipe bowl after each use. In addition, the provision of the filter disc 17 would filter out many of the undesirable elements of the smoke drawn by the smoker, and the aperture disc 24, particularly when including the channels 25*b* illustrated in FIG. 6, would tend to accumulate liquids separated from the tobacco, and thereby remove them from the smoke drawn into the smoker's mouth.

What is claimed is:

1. A tobacco cartridge for use with a narghile or other smoking appliance having a tobacco bowl for receiving tobacco, comprising: a quantity of tobacco enclosed within an enclosure; said enclosure having a lower end configured for applying the cartridge to the tobacco bowl of the smoking appliance, and an upper end which is openable to provide access to the tobacco for igniting same;

wherein said upper end of the enclosure includes a metal foil which is dimensioned such that, after opened to permit access to the tobacco for igniting same, it is foldable downwardly over and around the tobacco bowl for securing the cartridge to the tobacco bowl.

2. The tobacco cartridge according to claim 1, wherein said metal foil is aluminum foil.

3. The tobacco cartridge according to claim 1, wherein said lower end of the enclosure includes a metal base configured for reception in the tobacco bowl of the smoking appliance, and formed with a passageway for passing smoke from the tobacco, when ignited, into the smoking appliance.

4. The tobacco cartridge according to claim 1, wherein said quantity of tobacco in the cartridge is in the form of a disc.

5. The tobacco cartridge according to claim 4, wherein said cartridge further includes apertured metal disc underlying the disc of tobacco.

6. The tobacco cartridge according to claim 5, wherein said apertured metal disc is formed with channels for accumulating liquids separated from the tobacco when ignited.

7. The tobacco cartridge according to claim 5, wherein said cartridge further includes a second apertured metal disc overlying the disc of tobacco.

8. The tobacco cartridge according to claim 7, wherein said upper and lower discs are made of aluminum.

9. The tobacco cartridge according to claim 7, wherein said cartridge further includes a body of a combustible material overlying said second apertured disc and capable, when ignited, to produce a glowing ember for igniting the tobacco in the cartridge.

10. The tobacco cartridge according to claim 4, wherein said cartridge further includes a filter underlying said disc of tobacco therein.

11. The tobacco cartridge according to claim 1, wherein said enclosure further includes a filter underlying the quantity of tobacco therein.

12. A tobacco cartridge for use with a narghile or other smoking appliance having a tobacco bowl for receiving tobacco, comprising: a quantity of tobacco enclosed within an enclosure; said enclosure having a lower end configured for applying the cartridge to the tobacco bowl of the smoking appliance, and an upper end which is openable to provide access to the tobacco for igniting same; wherein said enclosure further includes a body of coal or wood capable, when ignited, to produce a glowing ember for igniting the quantity of tobacco within the cartridge.

13. A smoking appliance including a tobacco bowl for receiving a quantity of tobacco to be ignited in order to produce smoke, and a tobacco cartridge according to claim 1 carried in said tobacco bowl.

14. The smoking appliance according to claim 13, wherein said smoking appliance is a narghile which includes a water container for receiving a quantity of water through which the smoke passes before being drawn into the mouth of the smoker.

* * * * *